US006002643A

United States Patent [19]

Tchakarov et al.

[11] Patent Number: 6,002,643

[45] Date of Patent: Dec. 14, 1999

[54] PULSER

[75] Inventors: Borislav J. Tchakarov, Houston, Tex.; Daniel C. Seutter, Sherwood Park, Canada

[73] Assignee: Computalog Limited, Calgary, Canada

[21] Appl. No.: 08/917,624

[22] Filed: Aug. 19, 1997

[51] Int. Cl.[6] ..... G01V 1/40

[52] U.S. Cl. ..... 367/85; 367/83; 175/50; 181/102

[58] Field of Search ..... 367/85, 83; 166/241.4; 175/40, 50; 181/102

[56] References Cited

U.S. PATENT DOCUMENTS

| | | | |
|---|---|---|---|
| 4,276,943 | 7/1981 | Holmes | 175/40 |
| 4,323,991 | 4/1982 | Holmes et al. | 367/83 |
| 5,103,430 | 4/1992 | Jeter et al. | 367/85 |
| 5,117,398 | 5/1992 | Jeter | 367/85 |
| 5,333,686 | 8/1994 | Vaughan et al. . | |
| 5,473,579 | 12/1995 | Jeter | 367/85 |
| 5,586,084 | 12/1996 | Barron et al. | 367/85 |
| 5,678,630 | 10/1997 | Shaw et al. | 166/241.4 |

*Primary Examiner*—Christine Oda
*Assistant Examiner*—Anthony Jolly
*Attorney, Agent, or Firm*—James E. Bradley; Andrew J. Dillon

[57] ABSTRACT

A downhole tool containing instruments and a pulser is landed within a string of drill pipe. The pulser has a pulser body and an orifice on a lower end. A piston slides within a bore in the body and has a signal poppet on a lower end. In an extended position, the signal poppet extends into and obstructs the orifice to reduce the flow of drilling fluid. In an open position, the signal poppet does not obstruct the orifice to increase the flow of drilling fluid. A bidirectional solenoid valve is located above the piston and has upper and lower electromagnetic coils and an axially moveable rod. The rod is movable between a closed position in an opening in the body and an open position away from the opening. The rod is moved to both positions in response to the instruments which sends signals to the coils. The mud pulser also has an on/off flow switch which is actuated by the commencement of mud circulation. Initially, the rod is in the closed position. The instruments take various measurements which are communicated through the pulser to the surface in the form of mud pulses. A mud pulse is generated when a coil is energized to move the rod to the open position. This forces the piston and signal poppet into the extended position to restrict mud flow. The rod is moved to the closed position when the other coil is energized. The signal poppet creates pulses which are detected at the surface.

17 Claims, 4 Drawing Sheets

PULSER

TECHNICAL FIELD

This invention relates in general to downhole tools and in particular to an improved pulser for measurement while drilling tools.

BACKGROUND ART

Measurement while drilling (MWD) allows for the surface acquisition of downhole data during drilling, thereby reducing the need for costly and time consuming drill string tripping and logging/survey runs otherwise necessary to acquire downhole data.

In modern MWD systems, information is usually communicated to the surface with downhole pulsers. Pulsers generate surges or pulses in drilling fluid or mud which is flowing through a drill string. The pulses are coded so that they can be sensed or "read" at the surface. In one type of pulser, pulses are created by partially obstructing an orifice in the drill string through which the drilling mud is flowing with a signal poppet. The signal poppet is moved rapidly in and out of the orifice so that a pressure spike may be detected at the surface. Some pulsers require many moving parts and require significant amounts of power which quickly deplete the energy reserves of battery powered tools. An improved pulser is desirable.

DISCLOSURE OF INVENTION

A downhole measurement tool containing measurement instruments and a pulser is located within a string of drill pipe. The pulser has a pulser body which lands on a shoulder in the drill string. The lower end of the body has a an axial orifice through which drilling fluid flows to the drill bit. A piston slidingly reciprocates within an axial bore in the body and has a signal poppet secured to a lower end.

The piston has an extended position wherein the signal poppet extends into and partially obstructs the orifice to reduce the flow of drilling fluid and create a mud pressure pulse. The piston also has an open position wherein the signal poppet is located above and does not obstruct the orifice to increase the flow of drilling fluid and eliminate the mud pulse.

A bidirectional solenoid is located above the piston and has upper and lower electromagnetic coils and an axially moveable rod extending therebetween. A lower end of the rod engages an opening in a portion of the body. The rod is movable between a closed position in the opening and an open position above the opening. The rod is moved to both positions by a driver circuit which sends signals to the coils.

The mud pulser also has a flow switch assembly which sends signals to the downhole electronic module upon commencement of mud circulation. The switch assembly is located in a chamber above the solenoid and reacts to mud flowing pressure by moving a plunger to close a switch.

The mud pulser is lowered into and landed in the drill string. Initially, the rod is in the closed position until a signal is sent from the driver. The instruments take various measurements which are communicated through the driver and pulser to the surface in the form of drilling mud pulses. A mud pulse is generated when a coil is energized by a signal from the driver. In response, the rod moves to the open position to force the piston and signal poppet into the extended position. This restricts mud flow through the drill pipe and creates a sharp pulse. The rod is moved to the closed position when the other coil is energized. The opening and closing of the signal poppet creates a sharp pulse which is detected at the surface.

BEST MODE FOR CARRYING OUT THE INVENTION

Figure 1:
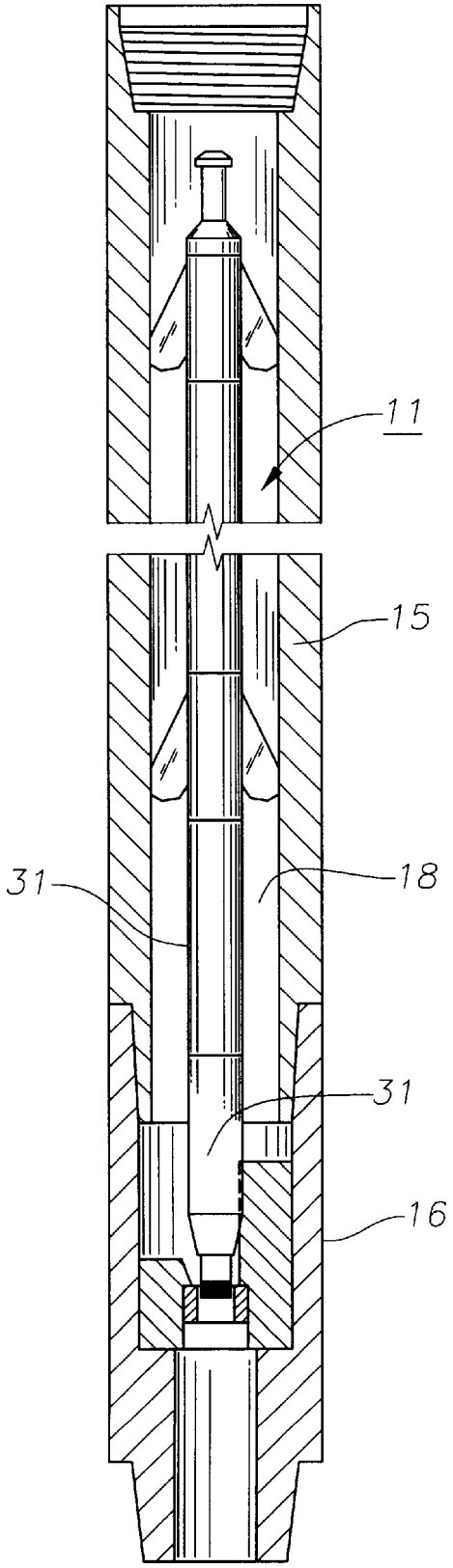
FIG. 1 is a schematic view of a well with a curved portion and a downhole MWD tool that is constructed in accordance with the invention.

Referring to FIG. 1, a battery powered downhole measurement tool 11 for use in a well is shown. Tool 11 is typically lowered into a well through the inner diameter of a string of drill pipe 15 and a muleshoe sub 16 on a wireline (not shown). The wireline is then retrieved. Drilling fluid is supplied to the drill bit (not shown) in the annulus 18 between tool 11 and drill pipe 15. Tool 11 comprises two or more measurement instruments in a module (not shown). One of the instruments makes a gamma ray measurement of the formation being drilled. Another of the instruments measures inclination and azimuth. The measurements are digitized and a driver circuit (not shown) supplies two digital signals, on and off, to a mud pulser 31. The instruments in the module are conventional.

Figure 2A:
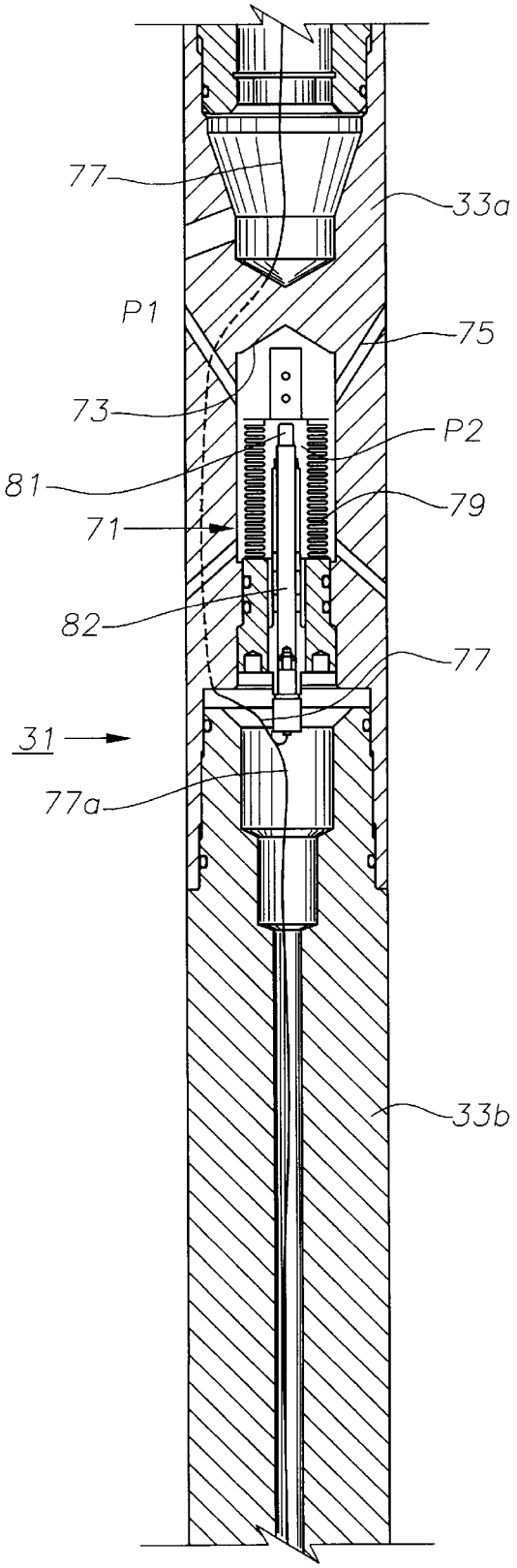
FIGS. 2A through 2D comprise a partial sectional side view of the pulser portion of the tool of FIG. 1.
Figure 2B:
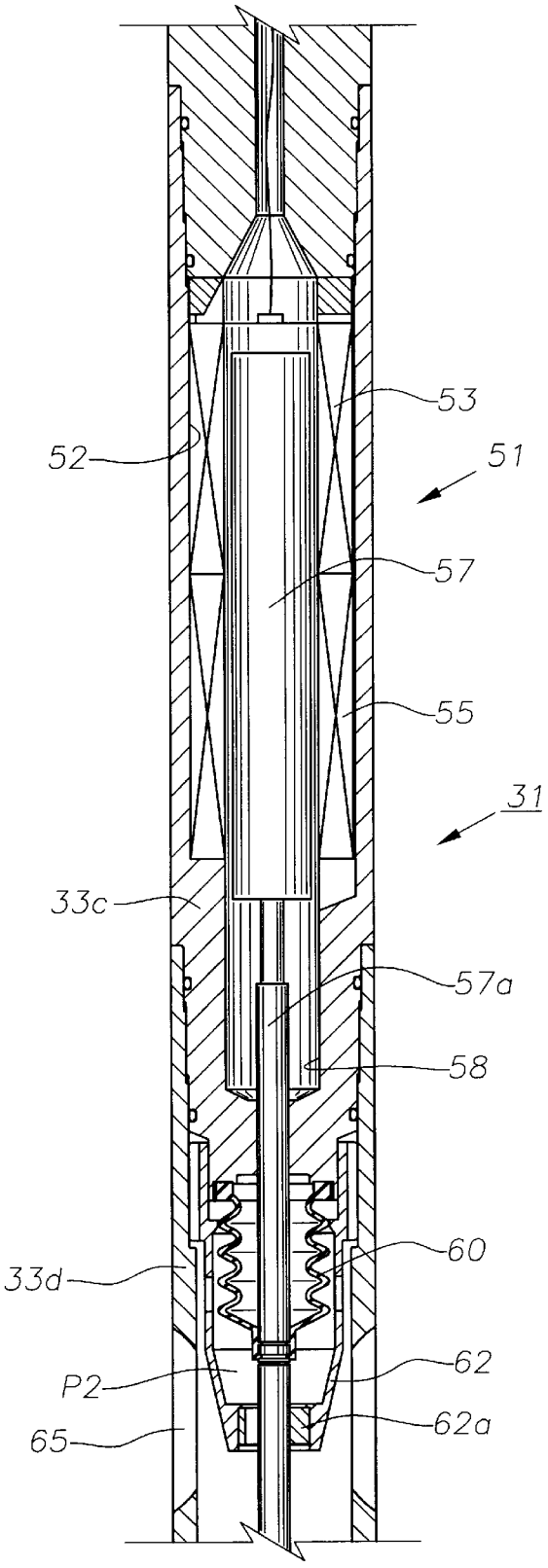
Figure 2C:
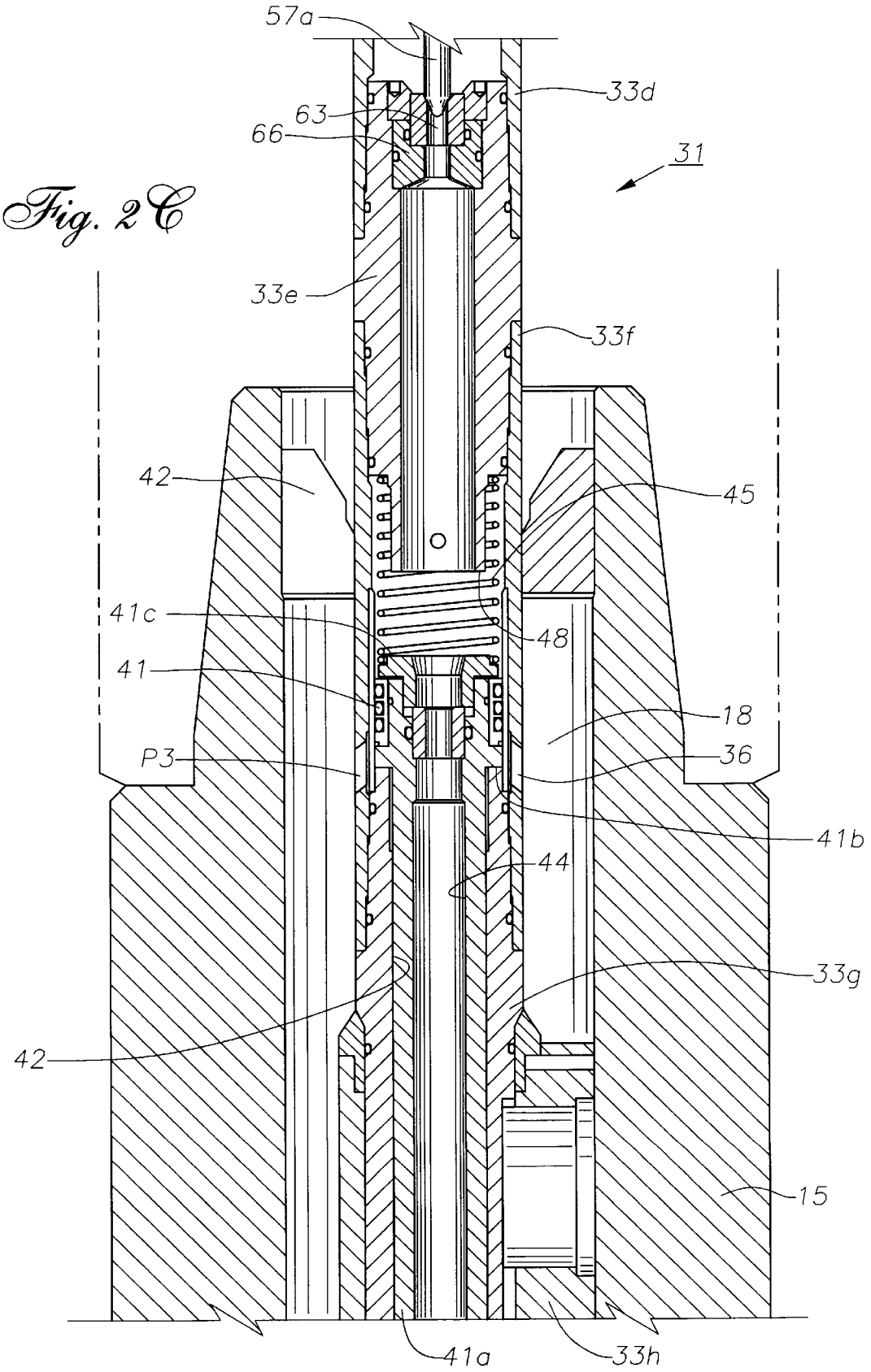
Figure 2D:
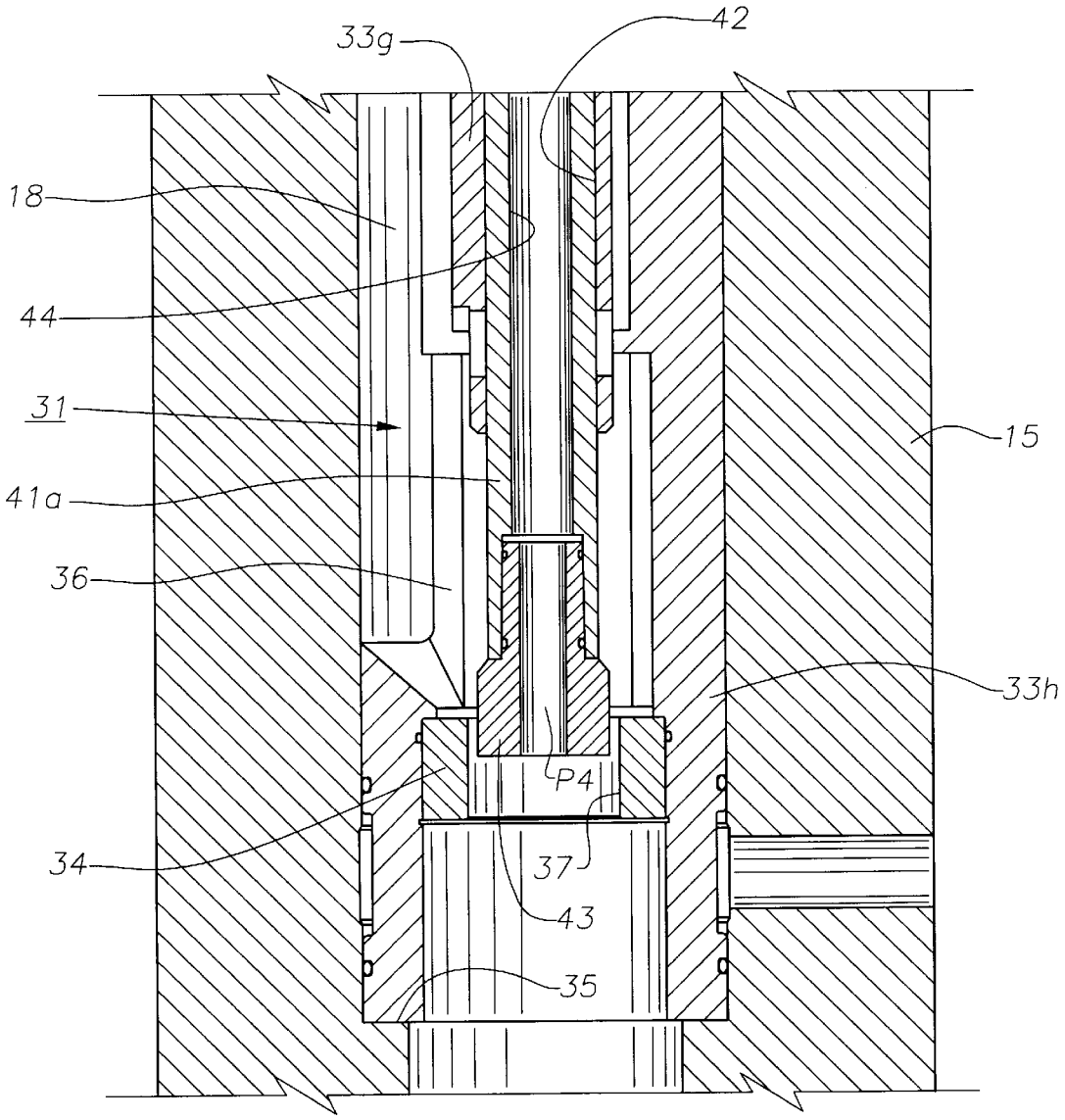

Referring also to FIGS. 2A–2D, pulser 31 creates pressure pulses in the stream of drilling fluid being circulated in annulus 18 in response to the digital signals provided by the driver circuit of the module. Pulser 31 has a generally cylindrical, hollow pulser body 33 with a number of body segments rigidly secured to one another. The lowermost segment of body 33, body segment 33*h*, lands on a shoulder 35 on a lower end of drill string 15 (FIG. 2D). The lower end of body segment 33*h* has a lateral passage 36 and an annular ring 34 with an axial orifice 37 through which drilling fluid in annulus 18 flows to the drill bit (not shown).

As shown in FIGS. 2C and 2D, a piston 41 slidingly reciprocates within an axial bore 42 in body segment 33*g*. Piston 41 has a lower tubular extension 41*a*, an axial bore 44 and a signal poppet 43 secured to a lower end of extension 41*a*. Signal poppet 43 is also hollow so that drilling fluid may flow through body segments 33*d*, 33*e*, 33*f*, bore 44 and out signal poppet 43 as well as around pulser 31 in annulus 18. A flange 41*b* at a lower end of piston 41 limits the downward movement of piston 41 by landing on an upper rim 46 on body segment 33*g*. Fluid pressure P3 enters a passage 36 in body segment 33*f* to apply pressure to flange 41*b* and force piston 41 upward. An upper end 41*c* of piston 41 limits its upward movement by bumping against a lower rim 48 on body segment 33*e*. A centralizer 42 extends outward from body segment 33*f* to centralize pulser 31 in muleshoe sub 16.

Piston 41 and signal poppet 43 are shown in an extended position in which signal poppet 43 extends into and partially obstructs orifice 37 in order to reduce the flow of drilling fluid and create a mud pressure pulse in annulus 18. Piston 41 and signal poppet 43 also have an open position (not shown) wherein signal poppet 43 is located above and does not obstruct orifice 37 in order to increase the flow of drilling fluid therethrough and eliminate the mud pulse. A strong compression spring 45 is located within body segment 33*f* between upper end 41*c* and a lower end of body segment 33*e* for biasing piston 41 to the closed position.

Referring to FIG. 2B, a bi-directional solenoid 51 is located above piston 41 within a chamber 52 in body segment 33*c*. Solenoid 51 has an upper electromagnetic coil 53, an immediately adjacent lower electromagnetic coil 55, and an axially moveable solenoid shaft 57. Solenoid shaft 57 is closely received by coils 53, 55. A servo poppet rod 57*a* is threadingly secured to a lower end of solenoid shaft 57. Servo poppet rod 57*a* extends downward through an axial bore 58 in body segment 33*c*. A lower end of servo poppet rod 57*a* is sealed in an expansible bellows 60 within a cylindrical housing 62, both of which extend into body segment 33*d* from a lower side of body segment 33*c*. Bellows 60 seals coils 53, 55 from drilling fluid. A servo rod centralizer 62*a* in housing 62 helps maintain servo poppet rod 57*a* in an axially centralized position.

As shown in FIG. 2C, the lower end of servo poppet rod 57*a* operates as a servo poppet by opening and closing an opening 63. Opening 63 is located in an annular ring 66 which is secured in an upper end of hollow body segment 33*e*. Opening 63 is slightly smaller than the diameter of rod 57*a* and smaller in diameter than orifice 37 (FIG. 2D). A lateral passage 65 extends through body segment 33*d* for communicating drilling fluid to opening 63 and body segments 33*e*, 33*f* to act on upper end 41*c* of piston 41 (FIGS. 2C and 2D).

Rod 57*a* is movable between a closed position (not shown) for obstructing fluid flow through opening 63 (not shown), and an open position for allowing fluid flow through opening 63 (FIG. 2C). To lift rod 57*a* from opening 63, the driver sends a signal to solenoid 51. Electrical current is applied to one of coils 53, 55 to overcome the differential pressure exerted by the drilling fluid tending to keep the lower end of rod 57*a* in opening 63. After rod 57*a* disengages opening 63, a lesser amount of current is required to keep rod 57*a* maintained in the open position. The instruments in the module and the driver may be programmed to keep rod 57*a* in the open position for one-quarter to three seconds. To close rod 57*a*, the driver provides another signal after the first signal goes off. With the second signal, current is applied to the other of coils 53, 55 to force shaft 57 downward. Once rod 57*a* lands in opening 63, the fluid pressure created by the surrounding flowing fluid is sufficient to keep it there without stimulating coil 53 or 55. Only one of coils 53, 55 is engaged at one time since one of the coils 53 or 55 is configured to lift and hold shaft 57 and the other is configured to push down on shaft 57.

As shown in FIG. 2A, mud pulser 31 also has a flow switch assembly 71 for sensing when mud circulation occurs. Flow switch assembly 71 energizes the module through wire 77 to provide signals to solenoid 51 through wire 77*a* upon commencement of mud circulation. Flow switch assembly 71 is located in a chamber 73 in body segment 33*a* above solenoid 51. A plurality of diagonal ports 75 extend through body segment 33*a* for communicating drilling fluid to chamber 73. Flow switch assembly 71 has a collapsible bellows 79 which contains an axially movable plunger 81. Bellows 79 contracts in response to a mud flow pressure differential between pressure P2 at passages 65 and pressure P1 at ports 75. When bellows 79 contracts, plunger 81 is moved downward to close a switch 82. Switch 82 is connected to the driver and measurement circuits by wire 77 to turn on the measuring and driver circuits.

In operation, mud pulser 31 is lowered into or otherwise installed in drill string 15. Before mud circulation, signal poppet 43 will be biased to the lower position by spring 45 as shown in FIG. 2D. Similarly, rod 57*a* is in its default closed position in opening 63 due to gravity. Rod 57*a* remains in the closed position until a signal is sent from the driver. As drilling commences and drilling fluid flows, signal poppet 43 moves upward to the open position since the pressure above piston 41 is lower than the pressure below it. The pressure above piston 41 is substantially the same as pressure P4 (FIG. 2D) at the inlet to piston extension bore 44, while the pressure below piston 41 is P3 (FIG. 2C).

Bellows 79 collapses under the pressure differential and actuates the system. The instruments take various measurements which are communicated through the driver and pulser 31 to the surface in the form of drilling mud pulses. A mud pulse is generated when coil 53 is energized by a signal from the driver. In response, shaft 57 moves rod 57*a* to the open position to allow drilling fluid to flow through opening 63. The force of spring 45 coupled with pressure P2 overcomes force P3 on piston 41, forcing signal poppet 43 downward into the extended position. This restricts mud flow through drill pipe 15, creating a sharp pulse. Shaft 57 is held in its open position by energized coil 53. The driver then simultaneously de-energizes coil 53 and energizes coil 55. In response, shaft 57 moves rod 57*a* to its closed position rapidly to reduce pressure P2 from applying pressure to upper end 41*c* of piston 41. Pressure P3 on flange 41*b* of piston 41 overcomes the force of spring 45 and causes signal poppet 43 to move quickly upward into the open position so that unobstructed fluid flow resumes. The opening and closing of signal poppet 43 creates a sharp pulse which is detected at the surface.

The invention has several advantages. The bidirectional solenoid provides very quick, precise control of the signal poppet since each step is timed electronically. The pulser also requires fewer moving parts than conventional pulsers. Finally, this pulser provides longer battery life since it requires less energy consumption at each operational step.

While the invention has been shown in only some of its forms, it should be apparent to those skilled in the art that it is not so limited, but is susceptible to various changes without departing from the scope of the invention.

I claim:

1. A downhole mud pulser for creating pressure pulses in a stream of drilling fluid being circulated through a drill string, the mud pulser responding to electrical signals provided by a measuring instrument coupled to the mud pulser, the mud pulser comprising:

a pulset body adapted to be connected into the drill string so as to define a main flow passage for the passage of drilling fluid;

an orifice adapted to be mounted in the drill string through which drilling fluid from the main flow passage is adapted to flow;

a tubular signal poppet having an annular piston reciprocally carried within the body and having a lower end which extends into the orifice to restrict flow and create a mud pulse while in an extended position, and which moves upward from the orifice to increase flow while in an open position;

an inner passage in the body extending through the piston and the signal poppet for the passage of drilling fluid from the main flow passage;

a port in the body leading from the main flow passage to a point below and in communication with the piston for supplying pressure from the drilling fluid;

an upward facing servo seat in the inner passage;

an axially movable servo poppet in the inner passage which moves between a closed position in engagement with the seat for blocking flow through the inner passage and an open position for allowing flow through the inner passage; and a bi-directional solenoid having a first coil, a second coil, and a rod extending within the coils, the servo poppet being connected to the rod for movement therewith, the coils being adapted to be electrically connected to the instrument, wherein the first coil, when engerized by one of the signals, moves the rod and the servo poppet to the open position which causes the signal poppet to move to the extended position for creating a mud pulse, and the second coil, when energized by another one of the signals, moves the rod and the servo poppet to the closed position which causes the signal poppet to move to the open position.

2. The pulser of claim 1, further comprising a flow switch assembly for turning on the instrument when fluid circulation begins, the switch assembly being located in a chamber in the tool which has ports to and from the chamber, and having a movable plunger which moves within the chamber for closing an electrical switch in response to fluid circulation.

3. The pulser of claim 2 wherein the switch assembly further comprises a bellows which encloses the plunger and collapses under fluid differential pressure to push the plunger downward to close the electrical switch.

4. A downhole mud pulser for creating pressure pulses in a stream of drilling fluid being circulated through a drill string, the mud pulser responding to electrical signals provided by a measuring instrument coupled to the mud pulser, the mud pulser comprising:

a pulser body adapted to be connected into the drill string so as to define a main flow passage;

an orifice adapted to be mounted in the drill string through which drilling fluid from the main flow passage is adapted to flow;

a signal poppet having a piston within the body and having a lower end which extends into the orifice to restrict flow and create a mud pulse while in a restricted position, and which moves away from the orifice to increase flow while in an open position;

an inner passage in the body leading from the main flow passage to one side of the piston for supplying pressure from the drilling fluid to urge the signal poppet to move to the restricted position;

a port in the body leading from the main flow passage to an opposite side of the piston for supplying pressure from the drilling fluid to urge the signal poppet to move to the open position;

an axially movable servo poppet which moves between a closed position for blocking flow in the inner passage to the piston to cause the signal poppet to move to the open position, and an open position for allowing flow through the inner passage to the piston to cause the signal poppet to move to the extended position; and a first coil, a second coil, and a rod extending within the coils, the servo poppet being connected to the rod for movement therewith, the coils being adapted to be electrically connected to the instrument, wherein the first coil, when energized by one of the signals, moves the rod in one direction and the servo poppet to the open position for causing the signal poppet to move to the restricted position for creating a mud pulse, and the second coil, when energized by another one of the signals, moves the rod in the other direction and the servo poppet to the closed position for causing the signal poppet to move to the open position.

5. The pulser of claim 4, further comprising a switch assembly for turning on the instrument when fluid circulation begins, the switch assembly being located in a chamber in the tool which has ports to and from the chamber, and having a movable plunger which moves within the chamber for closing an electrical switch in response to fluid circulation.

6. The pulser of claim 5 wherein the switch assembly further comprises a bellows which encloses the plunger and collapses under fluid pressure to push the plunger downward to close the electrical switch.

7. The pulser of claim 4 wherein the rod moves upward when it moves in said one direction and the rod moves downward when it moves in said other direction.

8. The pulser of claim 4 wherein the signal poppet moves upward when the rod moves downward and the signal poppet moves downward when the rod moves upward.

9. The pulser of claim 4 wherein the first coil is located above the second coil.

10. A measurement while drilling tool for installation in a drill string located in a borehole, the tool comprising:

a measuring instrument adapted to be located in the drill string for measuring a characteristic of the borehole and providing first and second digital signals;

a pulser body electrically connected to the instrument, the pulser body adapted to be located in the drill string, defining a main flow passage through which drilling fluid flowing down the drill string is adapted to flow;

an orifice adapted to be mounted in the drill string in the main flow passage;

a signal poppet having a lower end which extends downward into the orifice to restrict flow of drilling fluid and create a mud pulse while in an extended position, and which moves upward away from the orifice to increase flow of drilling fluid while in an open position;

an annular piston reciprocally mounted in the body, the signal poppet being connected to the piston for movement therewith;

a port in the body leading from the main flow passage to a lower side of the piston for applying pressure of drilling fluid in the main flow passage to a lower side of the piston to urge the signal poppet to the open position;

an inner passage in the body leading through the signal poppet and the piston for supplying drilling fluid pressure to an upper side of the piston to urge the signal poppet to the extended position;

a servo poppet in the inner passage which moves between a closed position for blocking flow in the inner passage to the upper side of the piston, and an open position for allowing flow through the inner passage to an upper side of the piston; and a bidirectional solenoid located within the body and electrically connected to the measuring instrument, the solenoid having first and second coils and a rod extending within the coils, the servo poppet being connected to the rod for movement therewith, wherein receipt of the first signal by the solenoid causes the first coil to move the rod and the servo poppet to the open position and holds it there for the duration of the first signal thereby causing the signal poppet to create a pulse in the drilling fluid, and wherein receipt of the second signal by the solenoid causes the second coil to move the rod and the servo poppet to the closed position, causing the signal poppet to move back to the open position.

11. The tool of claim 10, further comprising a switch assembly for turning on the instrument when fluid circulation begins, the switch assembly being located in a chamber in the tool which has ports to and from the chamber, and having a movable plunger which moves into the chamber for closing an electrical switch in response to fluid circulation.

12. The tool of claim 11 wherein the switch assembly further comprises a bellows which encloses the plunger and collapses under fluid pressure to push the plunger downward to close the electrical switch.

13. The tool of claim 10 wherein the servo poppet moves upward when it moves to the open position and the servo poppet moves downward when it moves to the closed position.

14. The tool of claim 10 wherein the signal poppet moves upward when the servo poppet moves downward and the signal poppet moves downward when the servo poppet moves upward.

15. The tool of claim 10 wherein the first coil is located above the second coil.

16. A measurement while drilling tool for installation in a drill string located in a borehole, the tool comprising:

a measuring instrument adapted to be located in the drill string for measuring a characteristic of the borehole and providing first and second digital signals;

a pulser body electrically connected to the instrument and adapted to be located within the drill string, the body defining a main flow passage for drilling fluid around at least a portion of the body;

an orifice adapted to be located in the drill string through which drilling fluid from the main flow passage is adapted to flow;

a valve member having a piston within the body and having a lower end which extends into the orifice to restrict flow of the drilling fluid and create a mud pulse while in a restricted position, and which moves away from the orifice to increase flow of the drilling fluid while in an open position;

an inner passage in the body leading from the main flow passage to one side of the piston;

a port in the body leading from the main flow passage to an opposite side of the piston;

a servo poppet mounted in the body for moving between open and closed positions, opening and closing, respectively flow from the main flow passage through the inner passage;

a drive member electrically connected to the instrument for moving the servo poppet to the open position, which allows hydraulic pressure from the drilling fluid in the main flow passage to reach said one side of the piston, causing the valve member to move to the restricted position to create a pulse, and for moving the servo poppet to the closed position, causing the valve member to move to the open position; and a switch assembly for turning on the instrument when fluid circulation begins, the switch assembly being located in a chamber in the tool which has ports to and from the chamber, and having a movable plunger which moves within the chamber for closing an electrical switch in response to fluid circulation.

17. The tool of claim 16 wherein the switch assembly further comprises a bellows which encloses the plunger and collapses under fluid pressure to push the plunger downward to close the electrical switch.

* * * * *

UNITED STATES PATENT AND TRADEMARK OFFICE

CERTIFICATE OF CORRECTION

PATENT NO. : 6,002,643
DATED : Dec. 14, 1999
INVENTOR(S) : *Tchakarov et al.*

It is certified that error appears in the above-identified patent and that said Letters Patent is hereby corrected as shown below:

On the cover page [75], please show inventor "Daniel C. Seutter's" address as --Sherwood Park, Alberta, Canada --.

In Col. 4, Claim 1, line 43, please delete "pulset" and insert --pulser --.

Signed and Sealed this

Twenty-first Day of November, 2000

*Attest:*

Q. TODD DICKINSON

*Attesting Officer*

*Director of Patents and Trademarks*